United States Patent [19]

Dach

[11] Patent Number: 4,637,823

[45] Date of Patent: Jan. 20, 1987

[54] HIGH TEMPERATURE FURNACE

[75] Inventor: Michael M. Dach, Houston, Tex.

[73] Assignee: Texaco Inc., White Plains, N.Y.

[21] Appl. No.: 275,097

[22] Filed: Jun. 19, 1981

[51] Int. Cl.[4] ..... C10J 3/68; F27D 1/00

[52] U.S. Cl. ..... 48/77; 432/247; 432/248; 432/251; 432/252; 110/336

[58] Field of Search ..... 432/247, 248, 251, 252; 110/331, 332, 336, 337; 48/77

[56] References Cited

U.S. PATENT DOCUMENTS

| | | | |
|---|---|---|---|
| 1,605,885 | 11/1926 | Willetts | 432/248 |
| 1,696,239 | 12/1928 | Jacobus | 110/336 |
| 1,754,514 | 4/1930 | Hobbs | 110/336 |
| 2,516,141 | 7/1950 | Newman et al. | 48/76 |
| 3,148,238 | 9/1964 | Willenbrock, Jr. | 432/248 |
| 3,315,950 | 4/1967 | Potocnik et al. | 110/336 |
| 3,416,780 | 12/1968 | Hanna | 110/336 |
| 3,528,647 | 9/1970 | Hyde | 432/252 |
| 3,560,164 | 2/1971 | Venable, Jr. | 110/331 |
| 3,779,699 | 12/1973 | Russell et al. | 432/247 |

*Primary Examiner*—Henry C. Yuen

*Attorney, Agent, or Firm*—Robert A. Kulason; Robert B. Burns

[57] ABSTRACT

The invention concerns the internal structure of a high temperature furnace. That structure includes a dome made of refractory bricks that are capable of withstanding the high temperature within a coal gasification generator. The structure also includes a supporting brick wall under the dome. And, it includes an inner wall made of refractory bricks. The latter is inside of the supporting wall. The inner wall shields the supporting wall from the highest temperature while it is free to expand without being subject to any compressive load from the dome.

1 Claim, 2 Drawing Figures

HIGH TEMPERATURE FURNACE

BACKGROUND OF THE INVENTION

1. Field of the Invention

This invention concerns high temperature furnace structure, in general. More specifically, it deals with an improvement in the internal structure for a high temperature furnace of the type which is used as the generator in a coal gasification procedure.

2. Description of the Prior Art

In a furnace of the type that is employed in connection with coal gasification or the like, the internal structure of the generator, i.e. furnace, includes an outer steel shell and it has the interior built up of walls of refractory bricks. These walls are held in place with insulating cement and by castable insulation. The geometric structure of the brick walls or columns includes a dome at the top to accommodate the hemispherical shape of the vessel itself. Such a generator is subjected to high wear conditions since the internal temperatures of the gasification process are extremely high and the generation of liquid slag tends to erode the inner surfaces of the walls. Such erosion is particularly heavy down the side walls below the dome configuration. Consequently, the operative life of such a furnace is limited, necessitating repair and rebuilding of the interior wall structure which is a time-consuming and expensive operation.

While various furnace wall interior structures have been shown in earlier patents, such as those to Liptak, No. 1,463,053; Dobie, No. 1,806,793; Beall, No. 2,114,960; Pollen, No. 2,548,908; Nygaard, No. 2,818,035; Potocnik et al, No. 3,315,950; and Boggum et al, No. 4,130,391; none of these has dealt with a principal concern of the applicant's invention, i.e. that relating to the ability to replace an inner wall of refractory bricks without disturbing the remainder of the furnace wall structure. Such remainder includes the dome that must be supported at the lower edges thereof.

Consequently, it is an object of this invention to provide for high temperature furnace structure that includes an inner hot face wall or lining of refractory bricks that can expand without raising the dome structure of the furnace interior.

Another object of the invention is to provide a high temperature furnace structure having a hot face wall or column of interior lining which can be replaced easily without concern for the support of the dome section of the furnace interior.

Another object of the invention is to provide a hot face brick wall or column that can withstand the high temperatures in a gasifier generator type of furnace, without requiring sufficient crushing strength to support the dome portion of such a furnace.

SUMMARY OF THE INVENTION

Briefly, the invention is in combination with a high temperature furnace having an outer shell and adapted for being mounted in an upright position. The furnace includes a temperature resistant lining with a dome at the upper end thereof. The said lining comprises at least one layer of first insulating means inside of said shell and supporting said dome. It also comprises second insulating means inside of said first insulating means. Said second insulating means is free standing inside the bottom of said dome, whereby said second insulating means may expand without applying any upward thrust to said dome.

Again briefly, the invention is in combination with a high temperature furnace having an outer shell and adapted for being mounted in an upright position. It includes a temperature resistant lining which comprises a dome constructed of refractory bricks and located at the upper end of said lining, and a first layer of firebricks having sufficient strength to support said dome and having said dome resting thereon. It also comprises a layer of insulating cement inside of and adjacent to said shell, and a plurality of layers of firebricks between said cement and said first layer of firebricks. It also comprises a second layer of free standing refractory bricks located inside of said first layer of firebricks for withstanding said high temperature. The said second layer comprises replaceable bricks and extends vertically above the bottom of said dome to permit expansion without any upward thrust to said dome. And, the temperature resistant lining comprises castable insulation filling spaces between said layer of insulating cement and said dome and said other layers of bricks.

Once more briefly, the invention concerns a high temperature furnace for coal gasification and the like, and it comprises a combustion chamber for carrying out said coal gasification having an inlet at the top of said chamber and an outlet at the bottom. It also comprises a dome surrounding said inlet and constructed of hot face brick for exposure to said coal gasification, and a first side wall for supporting said dome and constructed of insulating brick having sufficient crushing strength at temperatures below said coal gasification. It also comprises a second side wall inside of said first side wall and constructed of hot face brick for exposure to said coal gasification without support for said dome.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

In connection with coal gasification procedures and the like, there is a necessity for constructing a generator that is, in effect, a furnace where the gasification procedure takes place. Such a generator structure is, in fact, a furnace construction which includes a steel shell that must be lined with refractory materials in order to withstand the high temperatures of the gasification combustion taking place inside. Furthermore, the gasification of solids involves the generation of a high temperature liquid slag that tends to run down the walls of the furnace and is highly erosive in its effect on the inside of such wall. Consequently, the operative life of the interior lining structure is quite short, and the replacement process becomes very expensive. This is especially so since the usual structure involves a dome at the top of the furnace, which dome is formed of high temperature resistant refractory bricks and is supported by vertical side walls of similar refractory bricks therebelow. However, the erosive effects are much greater below the dome portion so that the lower wall portion is what needs replacement while the dome itself remains substantially intact. But, prior to this invention when the supporting walls needed replacement, the dome also had to be removed since the supporting walls beneath it were being removed for replacement thereof.

An internal structure of a furnace according to this invention provides for the inner wall layer of the furnace to be replaceable without concern for support of the dome. And, an additional benefit is realized in that the wall supporting the dome portion may be constructed of stronger bricks since they will not be subjected to the high temperatures or erosive conditions that the other interior surfaces of the furnace will be. Also, by having an interior layer made of hot face bricks, it may expand separately from the supporting wall structure of the dome. Thus, it is relieved of any support load or pressure caused by expansion effects.

It may be noted that in this disclosure the use of the terms "refractory bricks" is intended to be particularly concerned with extra high temperature bricks that can stand the hot face location on the inner lining of a furnace chamber. Also, the term "firebrick" is intended to connote a relatively high temperature resistant brick that, however, may be constructed to have better crushing strength than bricks designated as "refractory bricks."

Figure 1:
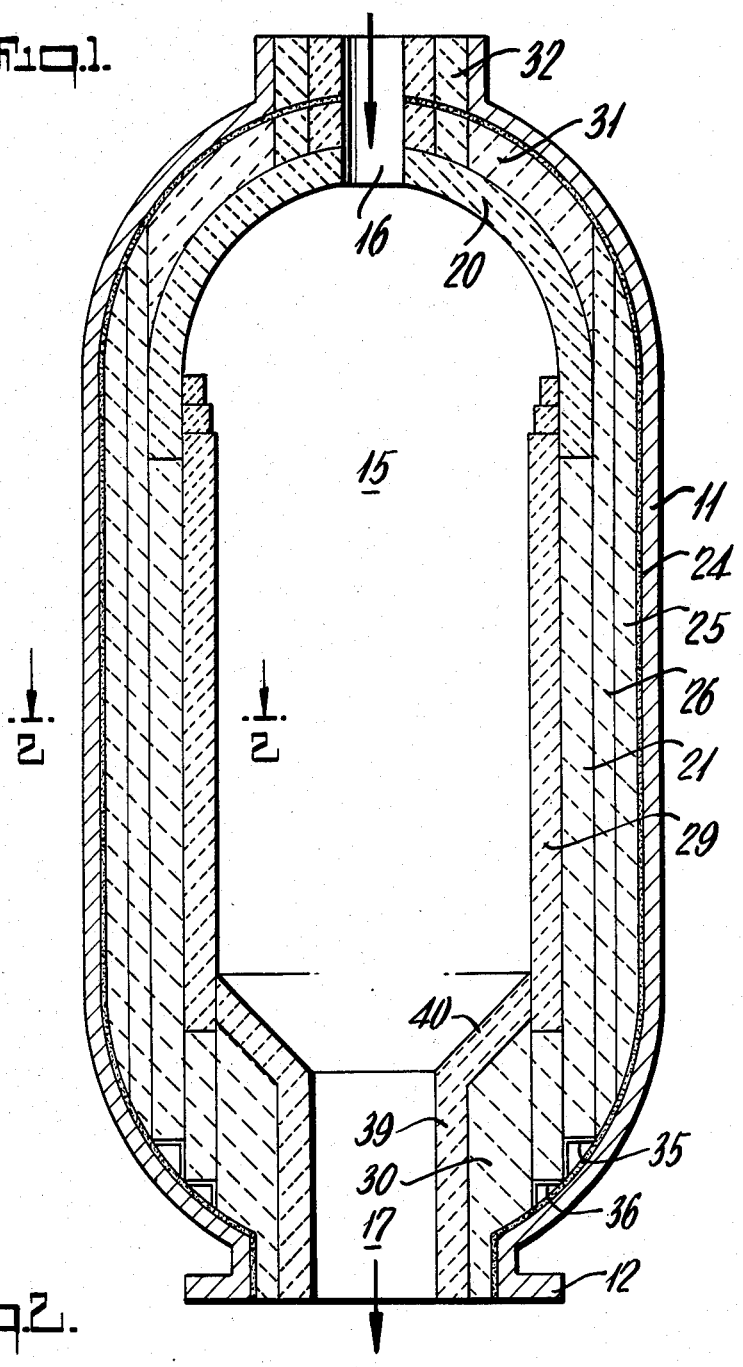
FIG. 1 is a schematic longitudinal cross section illustrating a furnace according to the invention.
Figure 2:
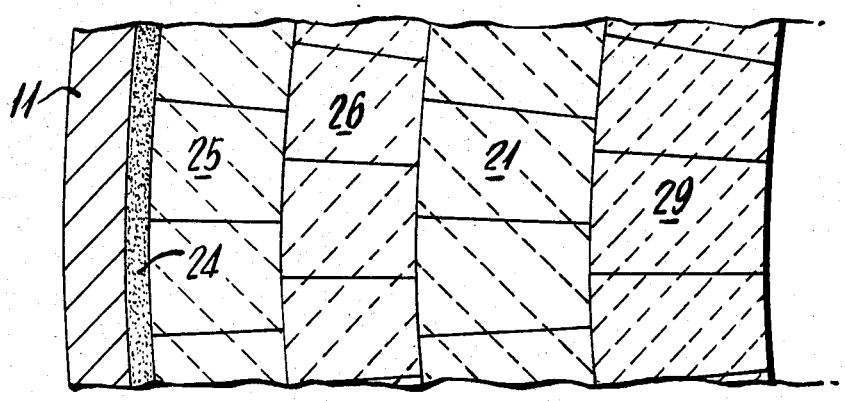
FIG. 2 is an enlarged lateral fragmentary cross section of one side wall of the furnace that is illustrated in FIG. 1, taken along the lines 2—2 of FIG. 1.

Referring to the drawings, it will be observed that there is a generator for coal gasification which is schematically illustrated as the high temperature furnace according to this invention. Thus, the furnace includes an outer shell 11 which may be constructed of any feasible material such as steel or the like. The shell 11 is adapted for mounting in an upright position such as indicated in FIG. 1. Consequently, there is a flange 12 at the bottom of the shell 11. Inside the furnace 11 there is a combustion chamber 15 where the coal gasification reaction takes place. And, there is an inlet 16 at the top and an outlet 17 at the bottom of the chamber 15.

Inside of the shell 11 there is a temperature resistant lining that includes a dome 20 which is constructed of refractory bricks and is, as indicated, located at the upper end of the furnace lining. Also, there is a first layer of firebricks 21 that is made of sufficient strength to support the dome 20. The base of the dome 20 rests on the top of the wall or columns of bricks 21. And, there is a layer of insulating cement 24 which is located inside of and adjacent to the shell 11. In addition, there are a plurality of layers 25 and 26 of firebricks that are located between the cement layer 24 and the first layer of firebricks 21.

There is a second layer of free standing refractory bricks 29 that is located inside of the first layer 21 and acts as so-called hot face bricks to withstand the high temperature within the chamber 15. This layer 29 is made up of replaceable bricks and it extends vertically above the bottom of the dome 20 so as to permit expansion of the wall or columns of brick layer 29 without any upward thrust or support applied to the dome 20.

The remaining spaces within the shell 11 are filled with castable insulation, i.e. insulation 30 near the bottom of the furnace and insulations 31 and 32 near the top. Also, it will be noted that the base of the layer of firebricks 21 is supported on an angle 35 while the freestanding layer of refractory bricks 29 is supported on another angle 36. It will be appreciated that the outlet 17 may be lined with a layer of refractory bricks 39 that has a frustoconical upper portion 40 which joins the base of the layer 29.

As indicated above, it will be appreciated that a primary benefit of the furnace structure according to this invention includes the ability of the hot face inner column 29 of bricks to expand without raising the dome 20 or applying extra compressive load to the columns of the layer 29. In addition, the hot face bricks of columns 29 may be replaced easily without concern for the support of the dome 20 since the dome is maintained with vertical support from the other columns of firebricks 21. Another benefit of the construction is that of having the hot face bricks of columns 29 constructed of materials that need not have extra strength for supporting the dome 20. Consequently, these bricks may be more effective for high temperature resistance as well as more economical.

While a particular embodiment of the invention has been described above in considerable detail in accordance with the applicable statutes, this is not to be taken as in any way limiting the invention but merely as being descriptive thereof.

I claim:

1. In combination, a high temperature furnace having an outer shell and adapted for being mounted in an upright position, a temperature resistant lining, comprising a dome constructed of refractory bricks and located at the upper end of said lining, a first layer of firebricks having sufficient strength to support said dome and having said dome resting thereon, a layer of insulating cement inside of and adjacent to said shell, a plurality of layers of firebricks between said cement and said first layer of firebricks, a second layer of freestanding refractory bricks located inside of said first layer of firebricks for withstanding said high temperature, said second layer comprising replaceable bricks and extending vertically above the bottom of said dome to permit expansion without any upward thrust to said dome, and castable insulation filling spaces between said layer of insulating cement and said dome and said other layers of bricks.

* * * * *